US007572142B2

(12) United States Patent
Katsuma

(10) Patent No.: US 7,572,142 B2
(45) Date of Patent: Aug. 11, 2009

(54) CONNECTOR

(75) Inventor: Takatoshi Katsuma, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/123,766

(22) Filed: May 20, 2008

(65) Prior Publication Data

US 2008/0293300 A1 Nov. 27, 2008

(51) Int. Cl.
*H01R 3/00* (2006.01)

(52) U.S. Cl. ..... 439/489; 439/862; 439/352; 439/595

(58) Field of Classification Search ..... 439/489, 439/862, 352, 595
See application file for complete search history.

(56) References Cited

U.S. PATENT DOCUMENTS 6,146,215 A * 11/2000 Matsushita et al. ..... 439/752.5
6,174,208 B1 * 1/2001 Chen ..... 439/852
6,439,171 B1 * 8/2002 McCall ..... 122/19.2
6,478,620 B1 11/2002 Bonavita et al.
7,033,217 B2 * 4/2006 Mase et al. ..... 439/595
7,108,551 B2 * 9/2006 Nishide ..... 439/595

* cited by examiner

*Primary Examiner*—Truc T Nguyen
(74) *Attorney, Agent, or Firm*—Gerald E. Hespos; Anthony J. Casella

(57) ABSTRACT

A connector has a terminal insertion opening (23) and a restriction (25) projects in at an inner corner of the terminal insertion opening (23). A terminal fitting (30) has a rectangular tube (31) and a positioning projection (43) projects out from the rectangular tube (30). The positioning projection (43) is offset laterally from the restriction (25) when the terminal fitting (30) is oriented properly so that the tube (30) can be inserted into the terminal insertion opening (20). However, the positioning projection (43) is offset rotationally from the restriction (25) when the terminal fitting (30) is oriented improperly so that a corner (41) of the rectangular tube (31) contacts the restriction (25). The corner (41) of the rectangular tube (31) has a higher strength than a cantilevered projection from the rectangular tube (31). Thus, the corner (41) will not be deformed by contact with the restriction (25).

17 Claims, 4 Drawing Sheets

CONNECTOR

BACKGROUND OF THE INVENTION

1. Field of the Invention

The invention relates to a connector.

2. Description of the Related Art

U.S. Pat. No. 6,478,620 discloses a connector with means for preventing a terminal fitting from being inserted into a cavity in an inverted posture. A rectangular tube is formed at the front end of the terminal fitting of this connector and a plate-like contact piece is placed on the upper surface of the rectangular tube of the terminal fitting. The contact piece is narrower than the rectangular tube and is displaced to either the left or right side of the upper surface of the rectangular tube at positions behind the front end of the rectangular tube. The entrance of the cavity is generally rectangular, but a recess corresponding to the contact piece is formed at the upper side of the opening edge. The contact piece fits into the recess when the terminal fitting is inserted into the cavity in a proper posture. However, the contact piece contacts the opening edge of the cavity after the front end of the rectangular tube is inserted into the cavity if an attempt is made to insert the terminal fitting in a vertically inverted improper posture.

The contact piece of the above-described connector interferes with the opening edge of the cavity when the terminal fitting is inserted in an improper posture. However, the contact piece is formed by causing a plate of the rectangular tube to extend like a cantilever, and hence has a relative low strength. Thus, the contact piece may be deformed upon contacting the opening edge of the entrance of the cavity.

The invention was developed in view of the above situation and an object thereof is to avoid the deformation of a terminal fitting when the terminal fitting is inserted in an improper orientation.

SUMMARY OF THE INVENTION

The invention relates to a connector with a housing that has at least one terminal insertion hole of substantially polygonal cross section. At least one restriction projects in at one of the inner corners at an insertion end of the terminal insertion hole. The connector also includes a terminal fitting that has opposite front and rear ends. A substantially polygonal tube is formed at the front end of the terminal fitting and is configured for insertion into the terminal insertion hole of the housing. At least one positioning projection is formed on the outer surface of one of the walls of the tube. The positioning projection contacts the inner surface of the insertion end of the terminal insertion hole at a non-interfering position relative to the restriction when the terminal fitting is inserted into the housing in a proper orientation. However, a corner edge of the tube contacts the restriction when an attempt is made to insert the terminal fitting into the housing in an improper orientation.

The corner edge that contacts the restriction is part of the tube, and hence is stronger than a cantilevered projection from the tube. There is no likelihood that the corner edge of the tube will be deformed or broken by contact with the restriction. Accordingly, also overall operability is improved.

The tube preferably is formed by bending a conductive plate material to have four or more walls connected via three or more bends. Any of the bends can define the corner edge that can interfere with the restriction.

The tube preferably is formed by bending a metal plate material substantially to have four walls connected via three bends, and any one of the three bends serves as the corner edge that can interfere with the restricting projection. The strength of the corner edge is higher than a case where an end edge of the metal plate material interferes with the restricting projection, and the deformation of the corner edge portion is prevented more reliably.

The tube preferably is formed with an overlapping wall extending from one of the walls and at least partly overlapping an adjacent wall.

The positioning projection preferably is formed by bending a part of the overlapping wall out at an angle and preferably at a substantially right angle.

The positioning projection preferably includes a parallel portion substantially parallel to the adjacent wall. An extending end surface of the positioning projection preferably is substantially opposed to the lateral end edge of the adjacent one of the walls.

The positioning projection preferably is arranged in a lateral direction to correspond to a lateral portion of one of the walls and/or the lateral surface of the positioning projection is at substantially the same position as the outer surface of another of the walls in lateral direction.

An end surface of the positioning projection preferably is substantially continuous and flush with end surfaces of the walls.

The restriction preferably extends in forward and backward directions more than about half the depth of the terminal insertion opening.

The connector further may comprise a one-piece resilient plug to be mounted to the housing and formed with at least one through hole substantially corresponding to the terminal insertion hole. A holder may be provided for holding the one-piece rubber plug on the housing.

A sum of vertical dimensions of the tube and the positioning projection preferably is smaller than the corresponding vertical dimension of the terminal insertion opening by as much as a clearance for permitting smooth insertion of the terminal fitting into the terminal insertion opening. Additionally, the width of the tube including the positioning projection is less than the width of the terminal insertion opening by as much as a clearance for permitting smooth insertion of the terminal fitting into the terminal insertion opening.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
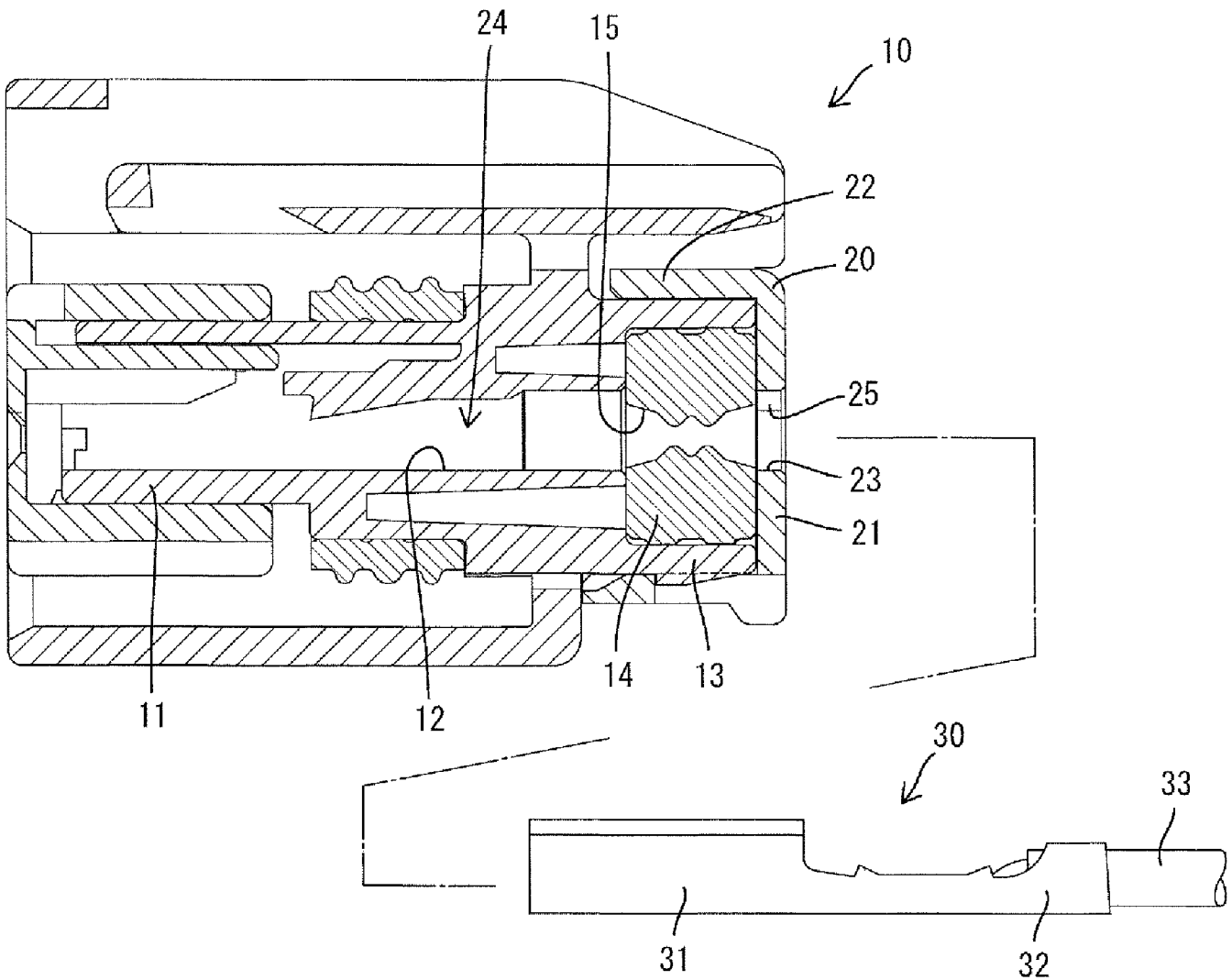
FIG. 1 is a section of one embodiment.
Figure 2:
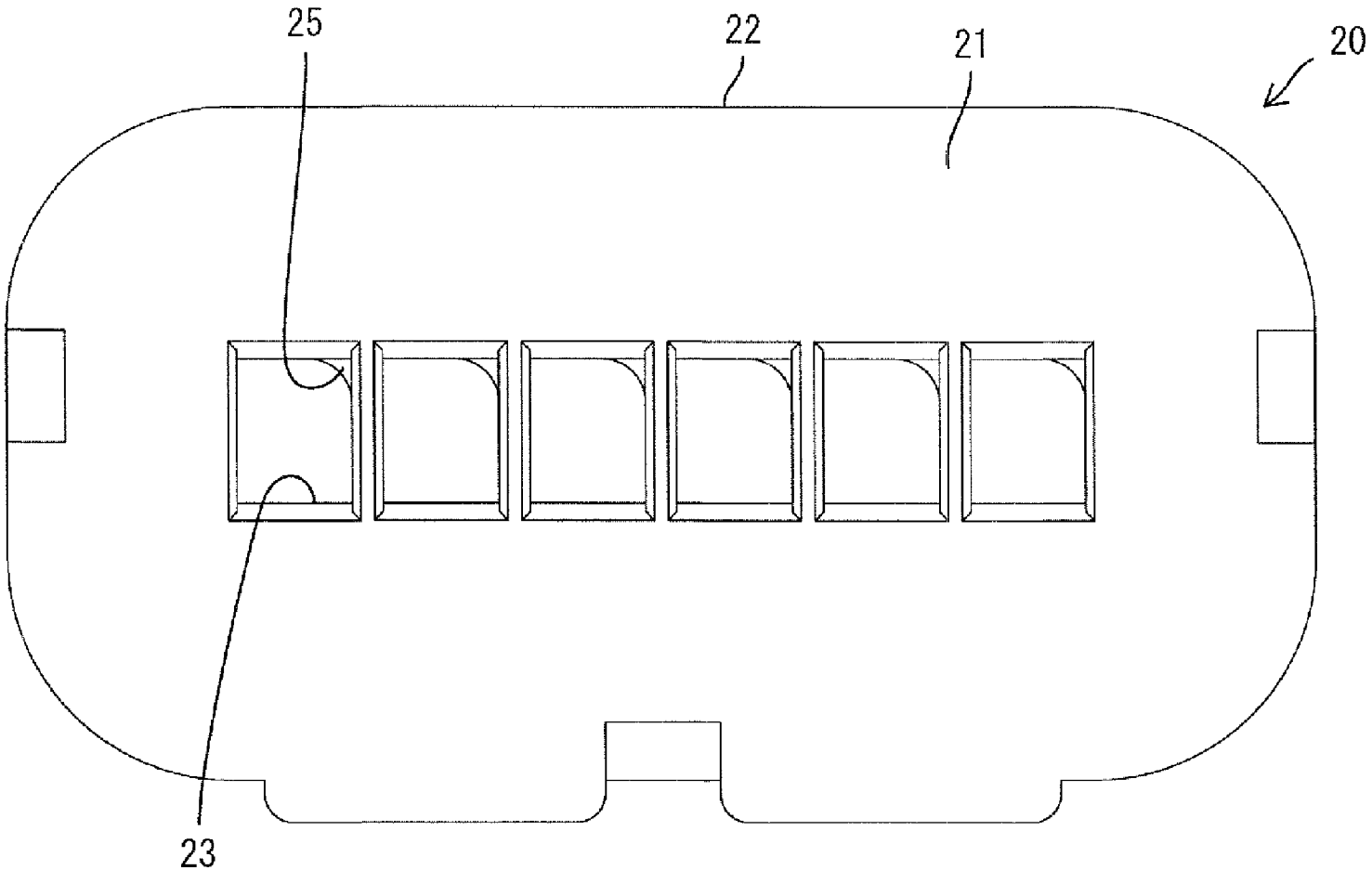
FIG. 2 is a rear view of a rear holder.

A connector in accordance with the invention is described with reference to FIGS. 1 to 4. The connector has a housing 10 and terminal fittings 30. The housing 10 includes a housing main body 11 made e.g. of synthetic resin, a rear holder 20 made e.g. of synthetic resin and a one-piece resilient (preferably rubber) plug 14. Long narrow terminal chambers 12 extend in forward and backward directions and are juxtaposed laterally. A tubular accommodating portion 13 extends back at the rear end of the housing main body 11, and the one-piece resilient plug 14 is accommodated therein. Through holes 15 penetrate the resilient plug 14 in forward and backward directions at positions corresponding to the respective terminal chambers 12, and circumferentially extending lips are formed on the inner circumferential surfaces of the respective through holes 15.

The rear holder 20 is assembled at the rear end of the housing main body 11 for preventing the resilient plug 14 from coming out of the housing main body 11. The rear holder 20 has a rear wall 21 and a tubular locking wall 22 extends unitarily forward the outer periphery of the rear wall 21. Terminal insertion openings 23 penetrate the rear wall 21 in forward and backward directions at positions corresponding to the respective terminal chambers 12 and the through holes 15. The rear holder 20 is assembled by fitting the tubular locking wall 22 on the rear end of the housing main body 11 so that the rear wall 21 covers the resilient plug 14. As a result, terminal insertion holes 24 for accommodating the terminal fittings 30 are formed by the terminal chambers 12, the through holes 15 and the terminal insertion openings 23.

Each terminal insertion opening 23 has a vertically long substantially rectangular shape, and a restriction 25 projects in from an inner peripheral surface of each terminal insertion opening 23 at a substantially right-angled corner where the first side and second sides (e.g. upper and right sides) of the opening edge meet. The restriction 25 is formed in a range in forward and backward directions more than about half the depth of the terminal insertion opening 23, and preferably from the front surface of the rear wall 21 (surface pushing the resilient plug 14) to a position slightly before the rear surface of the rear wall 21. In other words, the front surface of the restriction 25 is continuous and flush with the front surface of the rear wall 21. However, the rear surface of the restriction 25 is retracted from the rear surface of the rear wall 21 to form a step. The restriction 25 has a substantially triangular shape when viewed from behind, and has a slightly concave arcuate hypotenuse 25*a* that extends obliquely between the upper and right edges.

Each terminal fitting 30 is formed by bending a conductive metal plate material and has opposite front and rear ends. A substantially rectangular tube 31 is formed at the front half of each terminal fitting 30 and a wire crimping portion 32 in the form of an open barrel is formed at the rear end of each terminal fitting 30. The wire crimping portion 32 can be crimped, bent or folded into electrical connection with a front end portion of a wire 33.

The substantially rectangular tube 31 includes a first wall 34. A second wall 35 extends substantially perpendicularly down from a lateral edge of the first wall 34. A third wall 36 extends substantially perpendicularly from the end of the second wall 35 opposite the first wall 34 so that the first and third walls 34 and 36 are opposed to one another. A fourth wall 37 extends substantially perpendicularly from the edge of the third wall 36 opposite the second wall 35, so that the second and fourth walls 35 and 37 are opposed to one another. Although the tube 31 is substantially rectangular, tubes with polygonal shapes other than rectangular also may be employed. The first and second walls 34 and 35 are connected by a substantially quarter circular first bend 38; the second and third walls 35 and 36 are connected by a second substantially quarter circular bend 39; and the third and fourth walls 36 and 37 are connected via a substantially quarter circular third bend 40. The second bend 39 defines a corner edge 41 that could interfere with the restriction 35 as explained herein.

Figure 3:
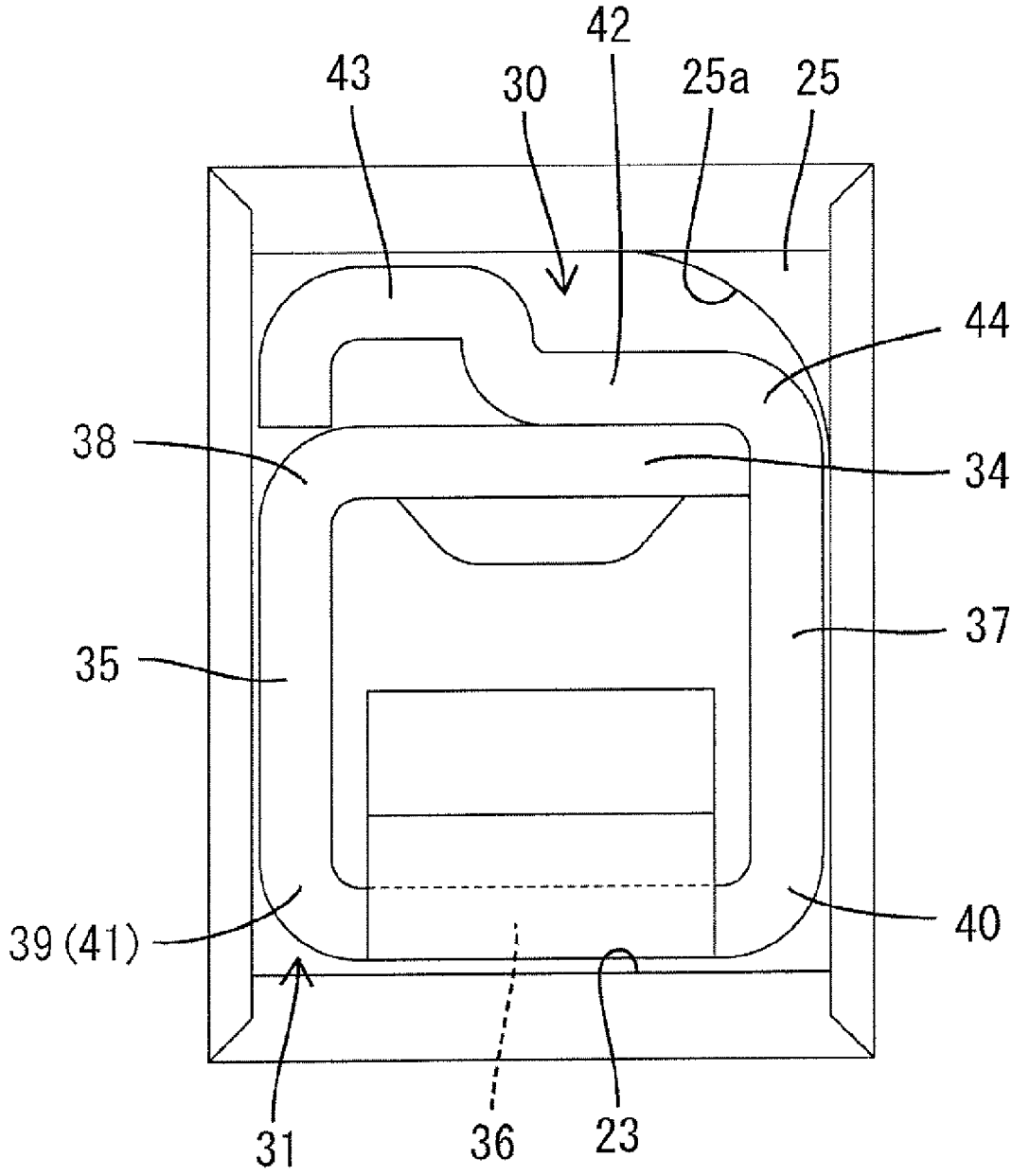
FIG. 3 is a partial enlarged rear view showing a state where a terminal fitting is inserted in a correct orientation.

As shown in FIG. 3, the rectangular tube 31 includes an overlapping wall 42 extending substantially perpendicularly from the edge of the fourth wall 37 opposite the third wall 36. A positioning portion 43 is formed by bending a side area of the overlapping wall 42 to project substantially perpendicularly out. The fourth wall 37 and the overlapping wall 42 are connected by a quarter circular fourth bend 44. The overlapping wall 42 is placed on the outer surface of the first wall 34 in a substantially half area adjacent the fourth wall 37. The positioning portion 43 is bent substantially perpendicularly out and away from the first wall 34, is bent again substantially perpendicularly to extend substantially parallel with the first wall 34 and then is bent again substantially perpendicularly to extend back inwardly and towards portions of the first wall 34 adjacent the first bend 38. The extending edge of the positioning portion 43 is substantially opposed to and close to the first wall 34 at the first bend 38. The positioning portion 43 is arranged to correspond substantially to a lateral half area of the first wall 34, and the outer lateral surface of the positioning portion 43 is located at substantially the same lateral position as the outer surface of the second wall 35. The front end surface of the positioning portion 43 preferably is substantially continuous and flush with front surfaces of the first through fourth walls 34-37 and overlapping wall 43.

A distance from the outer surface of the third wall 36 to the outer surface of the positioning portion 43 (sum of the outer dimensions of the rectangular tube 31 and the positioning portion 43) is smaller than the vertical dimension of the terminal insertion opening 23 by as much as a clearance for permitting the smooth insertion of the terminal fitting 30 into the terminal insertion opening 23. Further, the lateral dimension of the rectangular tube 31 parallel to the first and third walls 34 and 36, including the positioning portion 43, is smaller than the lateral dimension of the terminal insertion opening 23 by as much as a clearance for permitting the smooth insertion of the terminal fitting 30 into the terminal insertion opening 23.

Upon inserting the terminal fitting 30 into the terminal insertion hole 24 in a correct orientation, the positioning portion 43 is located at the lateral side of the rectangular tube 31, as shown in FIG. 3, and cannot contact the restriction 25 arranged at the substantially opposite lateral side of the terminal insertion opening 23. Further, the outer end surface of the positioning portion 43 comes substantially into contact with the inner upper surface of the terminal insertion opening 23. Accordingly, the rectangular tube 31 is positioned at a non-interfering position where the third wall 36 is substantially in contact with the inner bottom surface of the terminal insertion opening 23 with respect to a direction substantially perpendicular to the plane containing the first wall 34 on which the positioning portion 43 is arranged. Thus, the fourth bend 44 of the rectangular tube 31 is positioned obliquely inward and laterally from the restriction 25 and does not interfere with the restriction 25. Neither the rectangular tube 31 nor the positioning portion 43 interferes with the restriction 25, and the terminal fitting 30 can be inserted smoothly into the terminal insertion hole 24.

Figure 4:
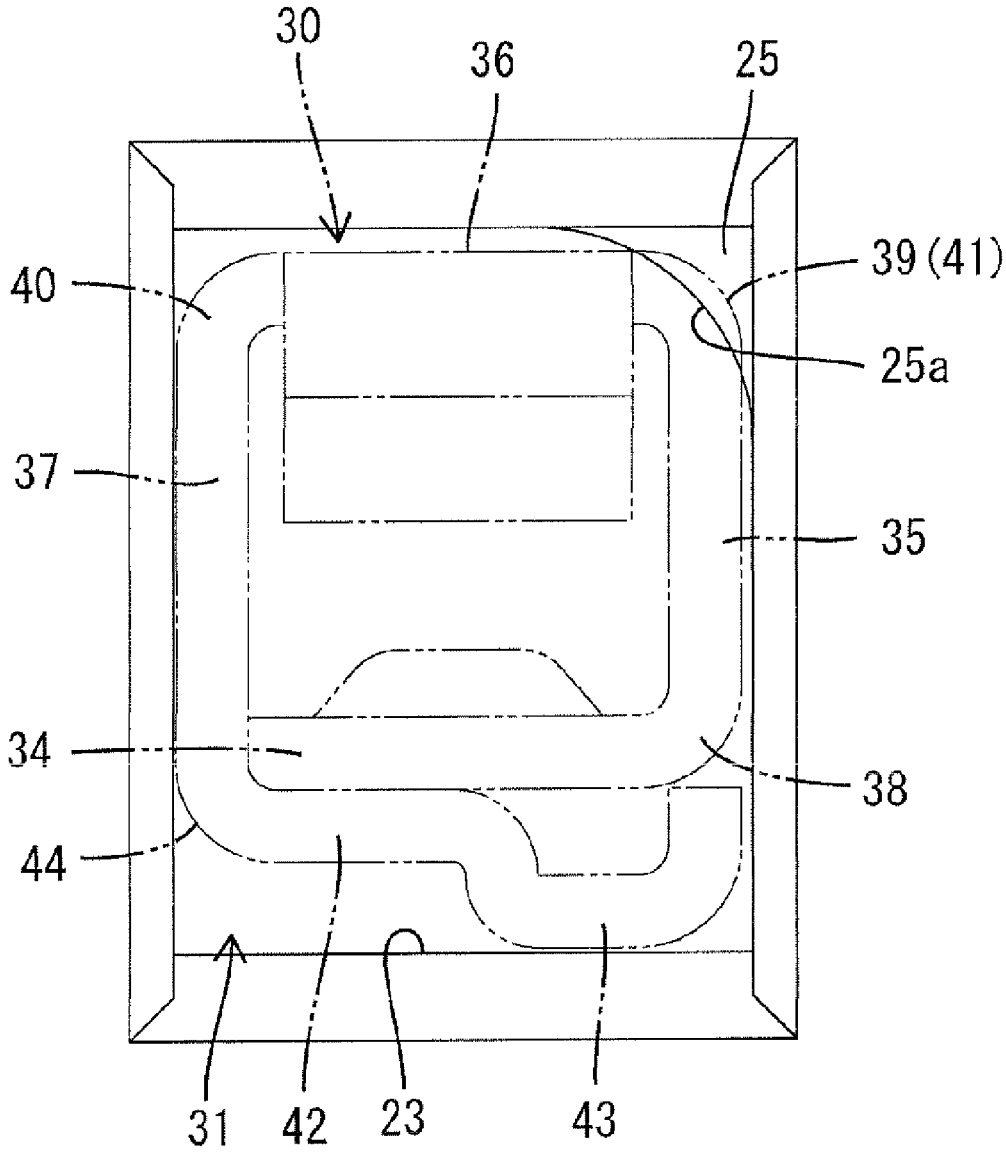
FIG. 4 is a partial enlarged rear view showing a state where the terminal fitting is inserted in a vertically inverted improper orientation.

On the contrary, if the terminal fitting 30 is inserted into the terminal insertion opening 23 in an improper posture (e.g. inverted orientation), the corner edge 41 (second bend 39) contacts the restriction 25 after the rectangular tube 31 and the positioning portion 43 slightly enter the terminal insertion opening 23. Specifically, as shown in FIG. 4, the positioning portion 43 is held substantially in contact with the bottom surface of the terminal insertion opening 23 as shown in FIG. 4. Thus, the rectangular tube 31 is lifted up from the non-interfering position to an interfering position located above. The third wall 36 of the rectangular tube 31 is located at the highest position in the terminal insertion opening 23 and contacts the inner upper surface of the terminal insertion opening 23. Thus, the corner edge 41 substantially diagonally opposite to the fourth bend 44 is located at the right upper corner of the terminal insertion opening 23, and as a result the corner edge portion 41 interferes with the restriction 25. The positioning portion 43 is located below the rectangular tube 31 and does not interfere with the restriction 25. The mutual interference of the corner edge 41 and the restriction 25 hinders any further insertion of the terminal fitting 30 so that insertion of the terminal fitting 30 in the vertically inverted improper is prevented.

As described above, the restriction 25 projects in from the lateral upper corner is formed at the rear end substantially rectangular terminal insertion opening 23 of the terminal insertion hole 24. The rectangular tube 31 of the terminal fitting 30 is formed with the positioning portion 43 projecting from the outer surface of the first wall 34 of the rectangular tube 31. The positioning portion 43 contacts the inner peripheral surface of the rear end of the terminal insertion opening 23 of the terminal insertion hole 24 in the process of inserting the terminal fitting 30 in the inverted or improper posture. Thus, the rectangular tube 31 is positioned at the interfering position and the front end of the corner edge 41 of the rectangular tube 31 contacts the restriction 25. The corner edge 41 that contacts the restriction 25 is part of the rectangular tube 31 and has a higher strength as compared with a projection that cantilevers from the rectangular tube 31. Therefore, there is no likelihood of being deformed or broken even if the corner edge 41 interferes with the restriction 25.

The tube 31 is formed by bending the conductive metal plate material substantially at right angles to have the first through fourth walls 34, 35, 36 and 37 connected by the first through third bends 38, 39 and 40. The second bend 39 forms the corner edge portion 41 of the rectangular tube 31 that can interfere with the restriction 25. The corner edge 41 is formed by the second bend 39 connecting the second and third walls 35 and 36 at a right angle. Thus, the strength of the corner edge 41 is high as compared with the case where an free end edge of the metal plate material is caused to interfere with the restriction 25. Therefore, the deformation of the corner edge 41 can be prevented reliably.

The invention is not limited to the above described and illustrated embodiment. For example, the following embodiments are also embraced by the technical scope of the present invention as defined by the claims.

The corner edge portion may be such that the end edge of the metal plate material comes into contact.

The shape of the restricting portion is not limited to the arcuate shape, and may be triangular or rectangular or any other shape.

The invention is also applicable to female terminal fittings having tabs projecting from the front ends of rectangular tube portions.

The housing is not limited to the one formed by assembling the rear holder with the housing main body and may be comprised of a single part.

The positioning portion may be arranged in the lateral center and two restricting portions may be arranged at the opposite lateral ends.

What is claimed is:

1. A connector, comprising:

a housing formed with at least one terminal insertion hole, at least one restriction projecting inwardly at an inner corner of an insertion end of the terminal insertion hole; and a terminal fitting having a tube at a front end thereof, the tube being formed with at least one positioning projection projecting out from a wall of the tube, the positioning projection being offset from the restriction when the terminal fitting is in a proper orientation so that the tube is at a non-interfering position that permits insertion of the terminal fitting into the housing, the tube have a corner edge aligned with the restriction and in an interfering position when the terminal fitting is in an improper orientation for preventing insertion of the terminal fitting into the housing in an improper orientation.

2. The connector of claim 1, wherein the tube is formed to have a substantially polygonal cross section by bending a conductive plate material to have at least four walls connected via at least three bends.

3. The connector of claim 2, wherein any one of the at least three bends serves as the corner edge that can interfere with the restriction.

4. The connector of claim 1, wherein the tube is formed with an overlapping wall extending from one of the walls and at least partly overlapping with an adjacent one of the walls.

5. The connector of claim 4, wherein the positioning projection is formed by bending a portion of the overlapping wall outward.

6. The connector of claim 4, wherein the positioning projection comprises a parallel portion substantially parallel to the adjacent wall and an extending end surface of the positioning projection being substantially opposed to a lateral end edge of the adjacent wall.

7. The connector of claim 1, wherein the positioning projection is arranged in lateral direction substantially corresponding to a lateral portion of one of the walls and a lateral surface of the positioning projection being aligned substantially with an outer surface of another of the wall portions in the lateral direction.

8. The connector of claim 1, wherein an end surface of the positioning projection is substantially flush with end surfaces of the walls.

9. The connector of claim 1, wherein the restriction is formed in a range in forward and backward directions more than about half of a depth of the terminal insertion opening.

10. The connector of claim 1, further comprising a one-piece resilient plug mounted to the housing and having at least one through hole substantially corresponding to the terminal insertion hole.

11. The connector of claim 10, further comprising a holder mounted to the housing and holding the plug on the housing.

12. The connector of claim 1, wherein a sum of cross sectional dimensions of the tube and the positioning projection is smaller than a corresponding cross sectional dimension of the terminal insertion opening by as much as a clearance for permitting smooth insertion of the terminal fitting into the terminal insertion opening, and wherein a width of the tube including the positioning projection is smaller than the width of the terminal insertion opening by as much as a clearance for permitting smooth insertion of the terminal fitting into the terminal insertion opening.

13. A connector, comprising:

a housing with a terminal insertion hole of a substantially rectangular cross section, a restriction projecting inwardly at an inner corner of the terminal insertion hole, the restriction being spaced laterally from a side surface of the terminal insertion hole by a selected lateral distance; and a terminal fitting with a substantially rectangular tube having upper and lower wall and first and second side walls, corners between adjacent walls, a positioning projection projecting out from the upper wall at a position aligned with an outer surface of the first side wall, the positioning projection having an outer cross-sectional width less than the lateral distance between the restriction and the side surface of the insertion hole so that the positioning projection can move between the restriction and the side surface of the terminal insertion hole when the terminal fitting is in a proper rotational orientation and so that one of the corners interferes with the restriction when the terminal fitting is in an improper rotational orientation.

14. The connector of claim 13, wherein the tube further has an overlapping wall extending from the second side wall and at least partly overlapping the first side wall, the positioning projection is formed by bending a portion of the overlapping wall outward.

15. The connector of claim 14, wherein the positioning projection comprises a parallel portion substantially parallel to the upper wall.

16. The connector of claim 15, wherein an end surface of the positioning projection is substantially flush with end surfaces of the walls.

17. The connector of claim 13, wherein the restriction is formed in a range in forward and backward directions more than about half of a depth of the terminal insertion opening.

* * * * *

UNITED STATES PATENT AND TRADEMARK OFFICE

CERTIFICATE OF CORRECTION

PATENT NO. : 7,572,142 B2
APPLICATION NO. : 12/123766
DATED : August 11, 2009
INVENTOR(S) : Takatoshi Katsuma It is certified that error appears in the above-identified patent and that said Letters Patent is hereby corrected as shown below:

On the Title Page, should read,

Item
(30) Foreign Application Priority Data

May 23, 2007 (JP) ..... 2007-136140

Signed and Sealed this

Fifteenth Day of September, 2009

David J. Kappos

David J. Kappos
*Director of the United States Patent and Trademark Office*